US011220777B2

(12) United States Patent
Nakashima et al.

(10) Patent No.: US 11,220,777 B2
(45) Date of Patent: Jan. 11, 2022

(54) WASHING MACHINE

(71) Applicant: Samsung Electronics Co., Ltd., Suwon-si (KR)

(72) Inventors: Takahiro Nakashima, Yokohama (JP); Yoshiyuki Nishioka, Osaka (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 103 days.

(21) Appl. No.: 16/669,104

(22) Filed: Oct. 30, 2019

(65) Prior Publication Data

US 2020/0131689 A1 Apr. 30, 2020

(30) Foreign Application Priority Data

Oct. 30, 2018 (JP) ..... JP2018-204368
Oct. 2, 2019 (KR) ..... 10-2019-0122356

(51) Int. Cl.

| | |
|---|---|
| ***D06F 39/02*** | (2006.01) |
| ***D06F 37/22*** | (2006.01) |
| ***D06F 39/08*** | (2006.01) |
| *D06F 37/20* | (2006.01) |
| *D06F 37/06* | (2006.01) |

(52) U.S. Cl.

CPC ..... *D06F 39/028* (2013.01); *D06F 37/22* (2013.01); *D06F 39/02* (2013.01); *D06F 39/022* (2013.01); *D06F 39/088* (2013.01); *D06F 37/06* (2013.01); *D06F 37/20* (2013.01); *D06F 39/08* (2013.01)

(58) Field of Classification Search

CPC ..... D06F 37/22; D06F 39/02; D06F 39/022; D06F 39/028; D06F 39/08; D06F 39/088

See application file for complete search history.

(56) References Cited

U.S. PATENT DOCUMENTS

2005/0274156 A1* 12/2005 Yang ..... D06F 39/028 68/17 R
2011/0247147 A1* 10/2011 Amos ..... D06F 39/02 8/137
2011/0277515 A1* 11/2011 Doh ..... D06F 39/08 68/17 R (Continued)

FOREIGN PATENT DOCUMENTS

CN 201546074 U 8/2010
CN 107916540 A 4/2018

(Continued)

OTHER PUBLICATIONS

Machine translation of WO-2018034456-A1 to Park et al. (Year: 2018).*

(Continued)

*Primary Examiner* — Joseph L. Perrin

(57) ABSTRACT

A washing machine capable of automatically supplying detergent while supplying water. The washing machine includes a body, a tub arranged inside the body, a detergent supplier configured to supply detergent to the tub, and a water supply pipe configured to supply washing water to the detergent supplier, and the detergent supplier includes a detergent box including an accommodating portion in which the detergent is placed, and a water supply plate configured to supply the washing water, which is supplied from the water supply pipe, to the detergent box.

13 Claims, 11 Drawing Sheets

(56) References Cited

U.S. PATENT DOCUMENTS

| | | | | |
|---|---|---|---|---|
| 2012/0060568 | A1* | 3/2012 | Buso | D06F 39/088 68/17 R |
| 2014/0157836 | A1* | 6/2014 | Zattin | D06F 39/028 68/17 R |
| 2017/0350060 | A1* | 12/2017 | Favaro | D06F 39/028 |
| 2019/0203404 | A1 | 7/2019 | Park et al. | |

FOREIGN PATENT DOCUMENTS

| | | | | |
|---|---|---|---|---|
| EP | 0318070 | A1 | 5/1989 | |
| EP | 2653601 | B1 | 2/2016 | |
| EP | 3184688 | A1 | 6/2017 | |
| JP | 09-117591 | A | 5/1997 | |
| JP | 2011-010987 | A | 1/2011 | |
| JP | 2012-170690 | A | 9/2012 | |
| KR | 10-2018-0020783 | A | 2/2018 | |
| WO | WO-2018034456 | A1 * | 2/2018 | D06F 37/06 |

OTHER PUBLICATIONS

International Search Report dated Apr. 29, 2020 in connection with International Patent Application No. PCT/KR2019/014295, 3 pages.
Supplementary European Search Report dated Aug. 24, 2021, in connection with European Application No. 19877736.9, 9 pages.

* cited by examiner

WASHING MACHINE

CROSS-REFERENCE TO RELATED APPLICATIONS

This application is based on and claims priority under 35 U.S.C. 119 to Korean Patent Application No. 10-2019-0122356, filed on Oct. 2, 2019, in the Korean Intellectual Property Office, which claims the benefit of Japanese Patent Application No. 2018-204368, filed on Oct. 30, 2018, in the Japan Patent Office, the disclosures of which are herein incorporated by reference in their entireties.

BACKGROUND

1. Field

The disclosure relates to a washing machine capable of automatically supplying detergent while supplying water.

2. Description of Related Art

A washing machine, which is configured in such a way that a detergent box containing detergent or bleach is provided on a water supply path, and the detergent is supplied to a washing tub from the detergent box with water at the time of water supply, thereby automatically supplying the detergent to the washing tub, is disclosed (for example, patent document 1).

RELATED ART DOCUMENT

Patent Document

Japanese Patent Publication No. 2013-9810

SUMMARY

Such a washing machine has noise and residual water caused by the detergent box.

In order to prevent the residual water in a detergent container 21 (i.e., a detergent box), the washing machine disclosed in patent document 1 may be provided with a drain aperture 35, which is formed on a water supply path 31*b* for supplying water to a water inlet 33, and an inclined portion 36, which is inclined downward from the water inlet 33 to the drain aperture 35, so as to allow water remaining in the water supply path 31*b* to be discharged to the drain aperture 35 without leaking from the water inlet 33.

However, due to the structure of the detergent container 21, the water supply path 31*b* does not have a sufficient height. Therefore, an inclination angle of the inclined portion 36 is very small and thus, when the residual water is large, the residual water may easily rise along the inclined portion 36 and then leak from the water inlet 33.

Further, in such a washing machine, it is common to supply a large amount of water intensely to distribute detergent into water so as to move the detergent into a washing tub without detergent remaining in the detergent container. Therefore, noise is generated as air is drawn in the water supply path 31*b* or water currents collide with each other. In the washing machine of patent document 1, the study about this noise is not disclosed.

Therefore, it is an aspect of the disclosure to provide a washing machine capable of effectively supplying detergent to a tub while preventing noise and residual water.

Additional aspects of the disclosure will be set forth in part in the description which follows and, in part, will be obvious from the description, or may be learned by practice of the disclosure.

In accordance with an aspect of the disclosure, a washing machine includes a water supply plate configured to supply water through a detergent box including a first accommodating portion in which detergent is placed.

The water supply plate may include a first water supply nozzle configured to introduce water, a first water supply portion configured to supply water to the first accommodating portion, and a first flow path configured to guide water, which is introduced from the first water supply nozzle, to the first water supply portion. A plurality of flow path partitions may be provided along the first flow path on an upstream side of the first flow path, and a size of a flow path cross section of the first flow path reduced by the flow path partitions may be increased as the first flow path becomes closer to a downstream side of thereof.

In accordance with another aspect of the disclosure, a washing machine includes a body, a tub arranged inside the body, a drum rotatably arranged in the tub, a detergent box installed to be inserted into or taken out from the inside of the body, and a water supply plate installed in the body to cover the detergent box and configured to supply water to the inside of the tub through the detergent box.

The detergent box may include a first accommodating portion in which detergent is placed. The water supply plate may include a first water supply nozzle configured to introduce water to the water supply plate, a first water supply portion provided with a washing water moving hole communicating with the first accommodating portion, and a first path configured to guide water, which is introduced from the first water supply nozzle, to the first water supply portion. A plurality of flow path partitions may be provided along the first flow path on an upstream side of the first flow path, and a size of a flow path cross section of the first flow path reduced by the flow path partitions may be increased as the first flow path becomes closer to a downstream side of thereof.

That is, as for the washing machine, the detergent may be put in the first accommodating portion of the detergent box and water may be supplied to the water supply plate from the first water supply nozzle. The water may flow to the first water supply portion through the first flow path and then the water may be supplied to the first accommodating portion through the washing water moving hole. Therefore, the water mixed with the detergent may be supplied to the inside of the tub and thus the detergent may be automatically supplied while supplying water.

In the washing machine, the plurality of flow path partitions may be provided along the first flow path on the upstream side of the first flow path, and the size of the flow path cross section of the first flow path reduced by the flow path partitions may be increased as the first flow path becomes closer to the downstream side of thereof.

Therefore, the momentum of the water introduced into the first flow path may be gradually reduced by the flow path partition. As a result, the impact caused by the inflow or collision of air may suppressed, and thus the noise may be reduced. In an experiment, it can be seen that a slight noise suppression effect is confirmed even when the flow path partition is installed as one stage and a sufficient noise suppression effect is confirmed when the flow path partition is installed as two or more stages. Therefore, as for the washing machine, because the flow path partition is provided in a plurality of stages, the noise may be further reduced and comfortable operation is possible.

The water supply hole of the first water supply nozzle may be formed smaller than a cross section of any flow path of the first flow path which is reduced by the plurality of flow path partitions.

Because the flow path cross section of the first flow path, which is reduced by the plurality of flow path partitions, becomes greater than the flow path cross section of the water supply hole, it is possible to obtain the same effect as adding one stage of the flow path partition. Therefore, the noise may be efficiently suppressed.

It is appropriate that the drain hole is formed on an upstream side than the flow path partition of the first flow path.

For example, because the first flow path partition placed in the most upstream side, among the plurality of flow path partitions is arranged in the vicinity of the first water supply nozzle, a branch flow path including a drain hole may be formed by branching from a part between the first flow path partition and the first water supply nozzle, in the first flow path, and a flow path cross section of the branch flow path may be smaller than the flow path cross section of the first flow path which is reduced by the first flow path partition.

Because the flow path cross section of the branch flow path is smaller than the flow path cross section of the first flow path which is reduced by the first flow path partition, the water may be prevented from flowing into the branch flow path upon flowing water from the first water supply nozzle, and thus it is possible to supply a large amount of water to the first water supply portion although the flow path partition and the branch flow path are provided.

Some of the water may be discharged through the drain hole. In a state in which the flow path partition (the first flow path partition) is arranged near the first water supply nozzle configured to introduce water into the first flow path, when the water is introduced at a high speed, the water pressure may be rapidly increased near the first water supply nozzle by the flow path partition, and thus the water may be prevented from smoothly flowing.

On the other hand, when a drain hole is provided on the upstream side than the flow path partition of the first flow path, the water pressure thereof may be reduced, and the introduced water may smoothly flow without stalling. Particularly, it is appropriate that the drain hole is arranged on the bottom surface of the first flow path. Because the detergent box is arranged on the lower side of the first flow path, the water discharged through the drain hole may be collected in the detergent box.

When the water is not introduced from the first water supply nozzle, air may be introduced through the drain hole and thus the inside of the first flow path may be maintained at atmospheric pressure (normal pressure). Therefore, the water may be discharged trough the drain hole, thereby preventing the residual water.

In this case, the first water supply nozzle may be directed toward a part opposite to a part where the branch flow path branches, in the first flow path.

Accordingly, because water is more difficult to flow in the branch flow path, more water may be supplied to the first water supply portion.

The water supply plate may include a plate body in which portions other than the upper portion of the first flow path are partitioned, and a plate cover integrated with the plate body by being fitted to the plate body and configured to block the upper portion of the first flow path. A drain aperture may be formed on the outside of a part, to which the first water supply nozzle is directed, in the first flow path.

In this case, because the plate cover and the plate main body are just in contact with each other, a gap may occur at the upper end of the first flow path. In the first flow path, water having high momentum may collide with a part to which the first water supply nozzle is directed. Therefore, the water may leak out from the upper portion to the outside.

On the other hand, according to this structure, because the drain aperture is formed in the outer side of this part, the water may be discharged through the drain aperture upon the leakage.

The detergent box may include a second accommodating portion separately provided from the first accommodating portion so as to accommodate detergent. The water supply plate may include a second water supply nozzle configured to introduce water, a second water supply portion configured to supply water to the second accommodating portion, a second flow path configured to guide water, which is supplied from the second water supply nozzle, to the second accommodating portion, and a third flow path extending along the first flow path from the first water supply portion while being joined to the second flow path at the upstream side of the second flow path, so as to supply water from the second water supply nozzle to the first water supply portion. In the third flow path, an inclined surface inclined downward toward a side surface of the second flow path may be provided in an end portion in the second flow path side, and a drain aperture may be formed on a lower portion of the inclined surface.

By using this structure, the water may be supplied from the first water supply nozzle to the first water supply portion while the water is supplied from the second water supply nozzle to the first water supply portion through the third flow path. Therefore, it is possible increase an amount of water to be supplied to the first water supply portion.

In this case, because the first water supply portion communicates with the second water supply portion via the third flow path, the water supplied from the first water supply portion may leak into the second water supply portion. Further, the water supplied from the second water supply portion may leak into the first water supply portion.

On the other hand, by using this structure, the inclined surface inclined downward toward the second flow path side is provided on an end portion of the third flow path in the second flow path side, and the drain aperture may be formed on the lower portion of the inclined surface. Therefore, because the water flowing back through the third flow path is guided to the drain aperture by the inclined surface, the water flowing back may be removed through the drain aperture, thereby suppressing an incorrect water supply (malfunctioning water supply).

In this case, the water supply plate may include the first flow path, the second flow path, the plate body in which a portion other than the upper portion of the third flow path is partitioned, and the plate cover integrated with the plate body by being fitted to the plate body and configured to cover the upper end of the first flow path, the second flow path and the third flow path. The drain aperture may be formed on the outside of a part, to which the first water supply nozzle is directed, in the first flow path.

As described above, although water leaks out from the upper portion of the first flow path, the leaked water may be discharged through the water aperture. Therefore, two functions may be performed by a single drain aperture, which is efficient.

Before undertaking the DETAILED DESCRIPTION below, it may be advantageous to set forth definitions of certain words and phrases used throughout this patent document: the terms "include" and "comprise," as well as derivatives thereof, mean inclusion without limitation, the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

FIGS. 1 through 8C, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The disclosure will now be described more fully with reference to the accompanying drawings. In the following detailed description, the terms of "front end", "rear end", "upper portion", "lower portion", "upper end", "lower end" and the like may be defined by the drawings, but the shape and the location of the component is not limited by the term.

The following description is merely illustrative in nature and does not limit the scope of the disclosure, its application, or its use. In addition, the front and rear direction, left and right direction, and up and down direction used by the following description are based on the arrow shown in FIG. 1 unless there is particular notice.

Hereinafter "detergent" may be used to include various types of detergents such as powder detergent and liquid detergent. In addition, the term "detergent" may be used to include not only general detergents but also various materials used for washing such as softeners and bleaches.

Figure 1:
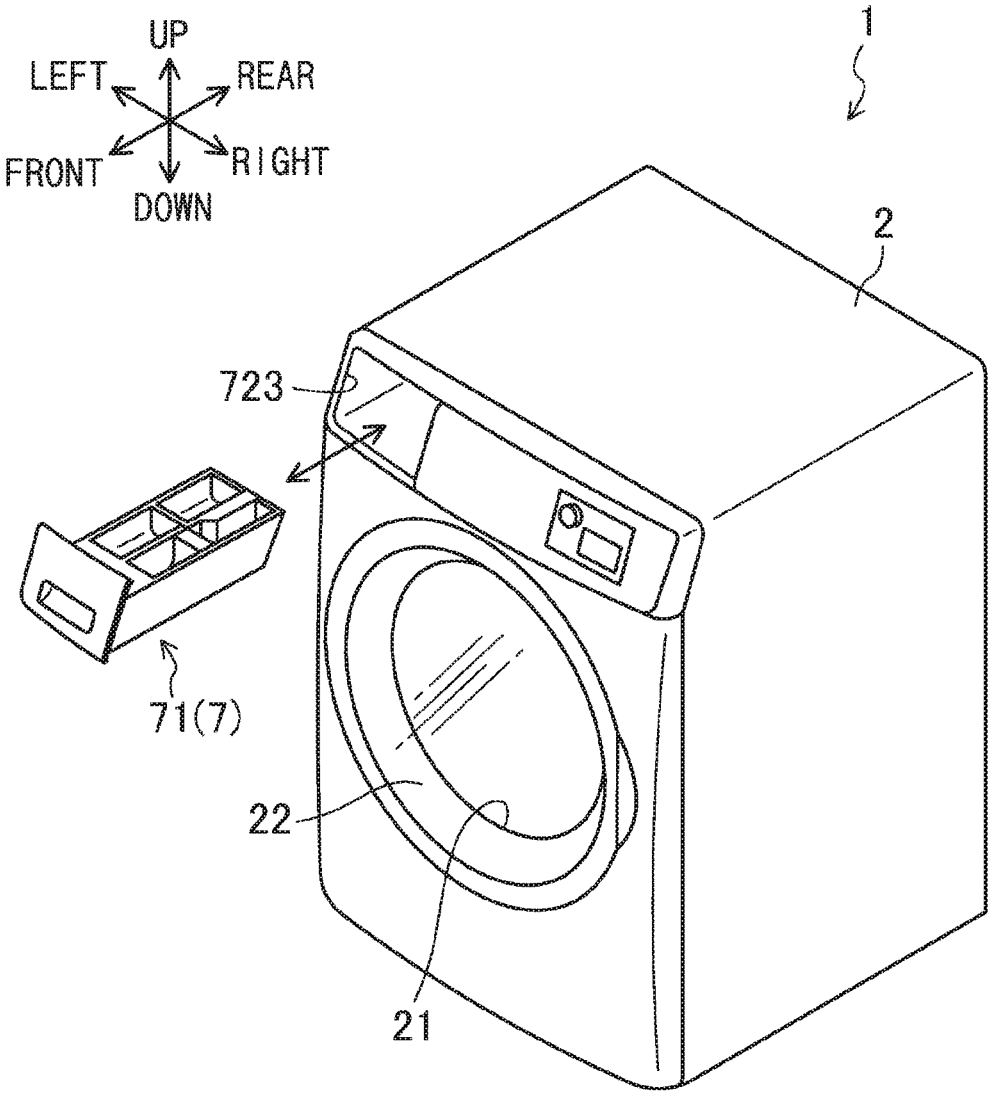
FIG. 1 illustrates a schematic perspective view of a washing machine according to an embodiment of the disclosure.
Figure 2:
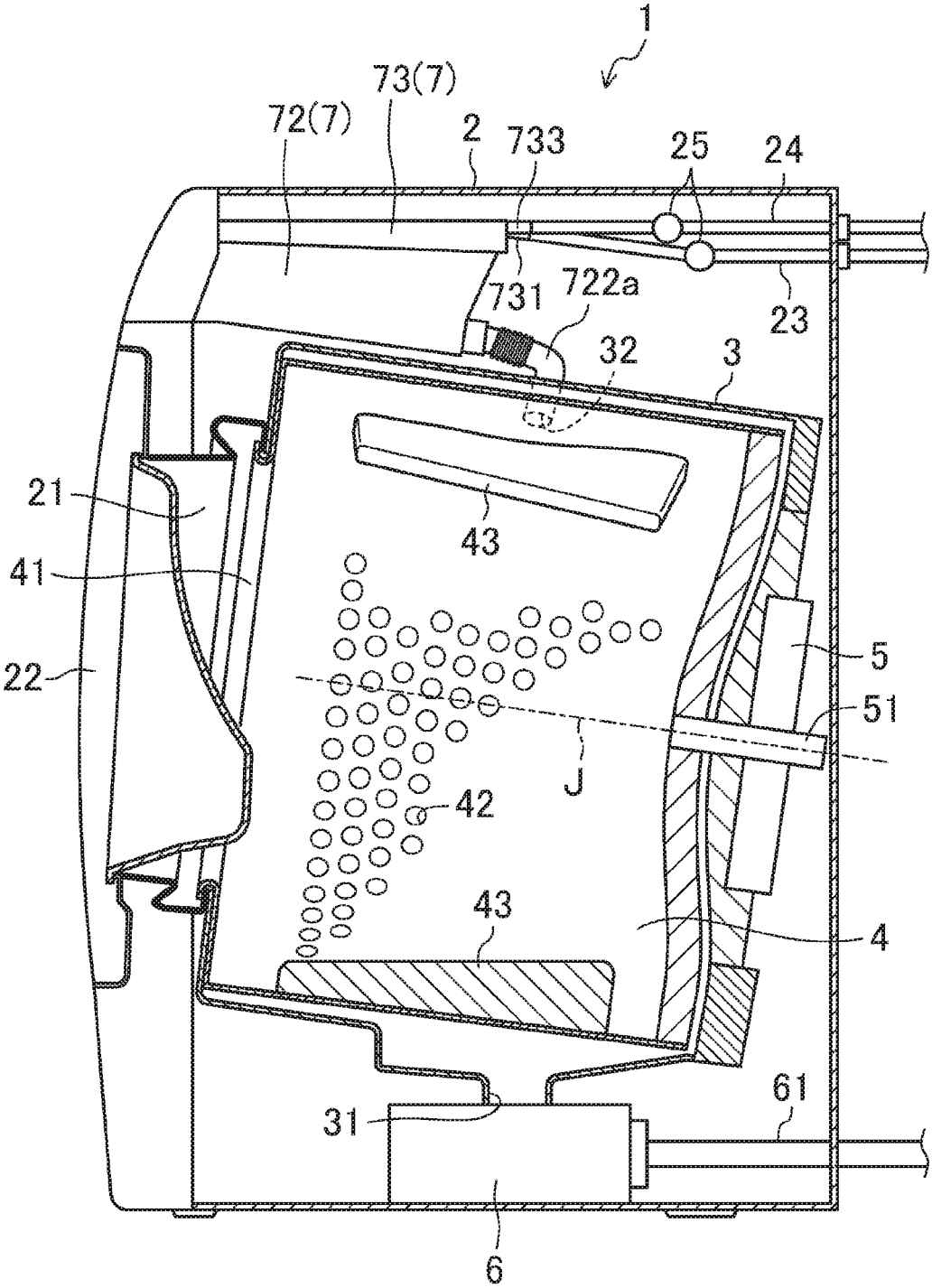
FIG. 2 illustrates a schematic cross-sectional view of the washing machine according to an embodiment of the disclosure.

FIG. 1 illustrates a schematic perspective view of a washing machine according to an embodiment of the disclosure, and FIG. 2 illustrates a schematic cross-sectional view of the washing machine according to an embodiment of the disclosure. A washing machine 1 illustrated in FIGS. 1 and 2 is a drum type washing machine. Further, the washing machine 1 is an automatic washing machine which is configured to automatically perform a series of process related to washing such as a washing process, a rinse process, and a dehydration process.

As illustrated in FIGS. 1 and 2, the washing machine 1 may include a body 2, a tub 3, a drum 4, a motor 5, and a drain pump 6. In order to automatically supply detergent while supplying water, the washing machine 1 may further include a detergent supplier 7 including a detergent box 71, a detergent box housing 72, and a water supply plate 73.

The body 2 is a box-shaped container formed of a panel or a frame, and the body 2 may form an appearance of the washing machine 1. The front of the body 2 is formed with a circular inlet 21 for putting in or taking out the laundry. The inlet 21 is provided with a door 22 having a transparent window. The inlet 21 is opened and closed by the door 22.

The tub 3 may be arranged inside the body 2. Particularly, the tub 3 communicating with the inlet 21 is placed inside the body 2. The tub 3 is formed by a cylindrical container having a bottom, and an opening of the tub 3 is connected to the inlet 21. The tub 3 is supported by a damper provided inside the body 2 so that the tub 3 is stabilized in a posture in which a central axis J of the tub 3 is slightly inclined upward. A discharge port 31 is provided under the tub 3. The discharge port 31 is connected to the drain pump 6. The drain pump 6 discharges the water collected in the tub 3 such as washing water or rinsing water to the outside of the washing machine 1 through a discharge pipe 61.

The motor 5 is installed in a rear part of the tub 3. A shaft 51 of the motor 5 penetrates the rear of the tub 3 and protrudes into the tub 3. A front end of the shaft 51 is fixed to the center of the rear part of the drum 4.

The drum 4 may be rotatably arranged inside the tub 3. The drum 4 is formed by a cylindrical container having a diameter slightly smaller than that of the tub 3, and the drum 4 is arranged in the tub 3 in a state in which the central axis J of the drum 4 is aligned with the tub 3. A circular opening 41 corresponding to the inlet 21 is formed on a front surface of the drum 4. A plurality of dehydration holes 42 are formed on the entire of the drum 4 (some of the dehydration holes are shown in FIG. 2). Further, an alternate lifter 43 is provided in a plurality of places on the inner surface of the side portion.

Although a detailed structure is omitted, the front portion of the drum 4 is rotatably supported by the inlet 21. Therefore, the drum 4 rotates about the central axis J by the drive of the motor 5. In addition, a controller (not shown) including a CPU, and a memory for controlling the driving of each device of the washing machine 1 such as the motor 5 and the drain pump 6 is provided above the body 2.

Figure 3:
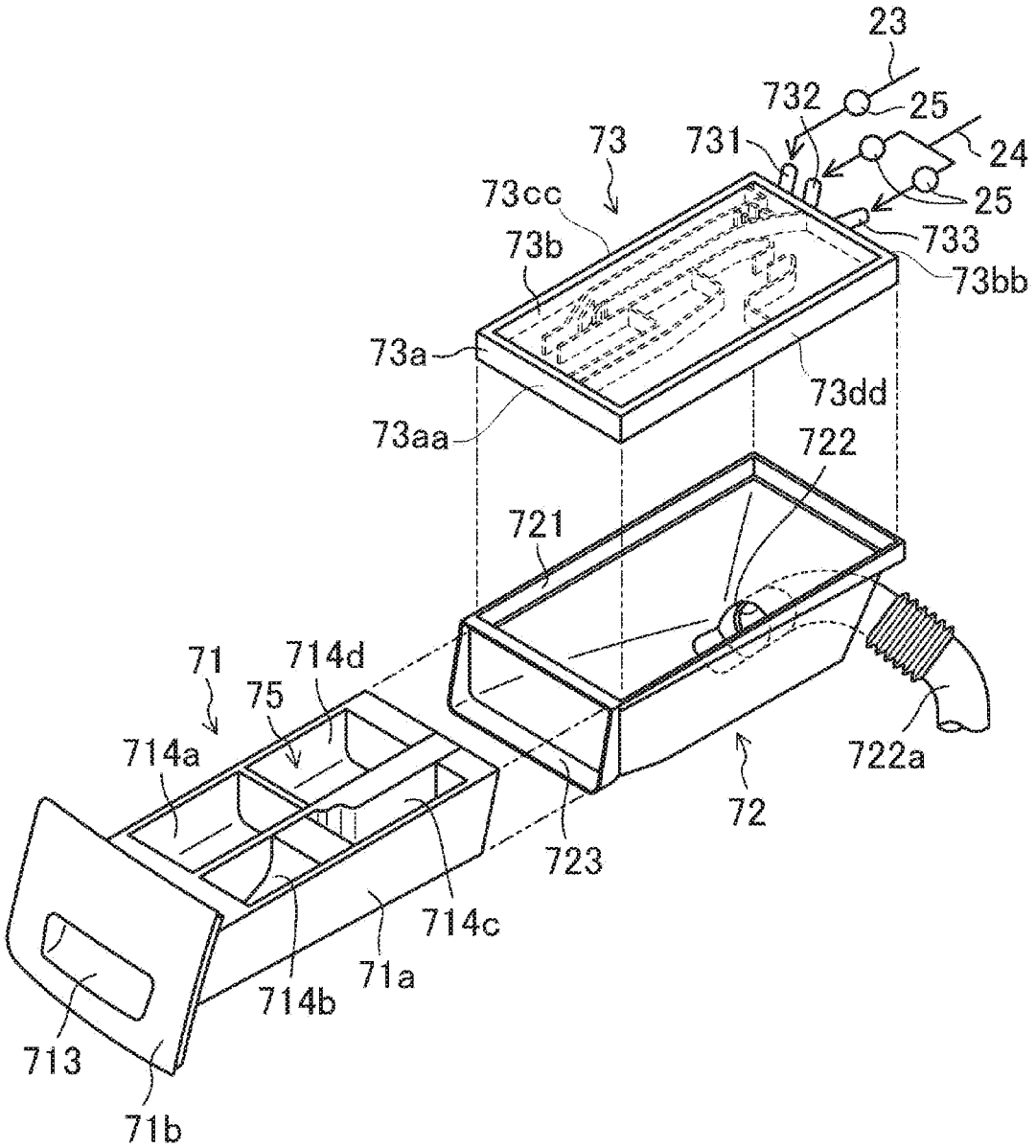
FIG. 3 illustrates a schematic exploded perspective view of a detergent supplier of the washing machine according to an embodiment of the disclosure.

FIG. 1 illustrates a schematic perspective view of a washing machine according to an embodiment of the disclosure, and FIG. 2 illustrates a schematic cross-sectional view of the washing machine according to an embodiment of the disclosure. FIG. 3 illustrates a schematic exploded perspective view of a detergent supplier of the washing machine according to an embodiment of the disclosure.

As illustrated in FIGS. 1 to 3, the detergent supplier 7 may be configured to supply detergent to the tub 3. The detergent supplier 7 may include the detergent box 71, the detergent box housing 72, and the water supply plate 73. The detergent supplier 7 may be provided inside the body 2, and arranged above the tub 3. The detergent housing 72 and the water supply plate 73 may be fixed to the body 2. As illustrated in FIG. 1, the detergent box 71 may be provided to be taken out from the front of the body 2. That is, the detergent box 71 may be installed to be inserted into the body 2 and to be taken out from the body 2. In other words, the detergent box 71 may be provided to be taken out from the detergent box housing 72.

The detergent box housing 72 is a tray-shaped container having a length in the front-rear direction. An opening 721 on which the water supply plate 73 is mounted is formed on an upper surface of the detergent box housing 72. The bottom of the detergent box housing 72 is inclined downward toward the rear. A water outlet 722 is formed at the rear end of the bottom of the detergent box housing 72. Through a connection pipe 722*a*, the water outlet 722 is connected to a tub water inlet 32 opened on the upper portion of the tub 3.

The front surface of the detergent box housing 72 is formed with a mounting opening 723 into which the detergent box 71 is inserted or from which the detergent box 71 is taken out. The detergent box housing 72 is mounted to the body 2 such that the mounting opening 723 is opened to the front of the body 2 as illustrated in FIG. 1.

The detergent box 71 may include a detergent box body 71*a* accommodated in the detergent box housing 72 and a detergent box cover 71*b* provided in front of the detergent box body 71*a*. The detergent box cover 71*b* is provided to cover the mounting opening 723 based on a state of the detergent box 71 being accommodated in the detergent box housing 72. A groove portion 713 serving as a handle is formed on a front surface of the detergent box cover 71*b*.

The detergent box body 71*a* may be provided with a plurality of accommodating portions 714*a*, 714*b*, 714*c*, and 714*d* (four portions from a first to a fourth accommodating portions are provided according to an embodiment) in which detergent may be accommodated. The accommodating portions 714*a*, 714*b*, 714*c*, and 714*d* are respectively formed in the form of a tray, and a water inlet opening 75 is provided on the upper surface thereof.

Particularly, the first accommodating portion 714*a* may be arranged on the front left side of the detergent box body 71*a*. The second accommodating portion 714*b* may be arranged on the front right side of the detergent box body 71*a*. The third accommodating portion 714*c* may be arranged on the rear right side of the detergent box body 71*a*. The fourth accommodating portion 714*d* (actually, used for drainage) may be arranged on the rear left side of the detergent box body 71*a*. The fourth accommodating portion 714*d* may be referred to as a "preliminary accommodating portion".

For example, when washing is performed, detergent (powder or liquid) is accommodated in the first accommodating portion 714*a*. Further, softener (powder or liquid) is accommodated in the second accommodating portion 714*b* as needed. Bleach (powder or liquid) is accommodated in the third accommodating portion 714*c*.

When water is supplied to the first accommodating portion 714*a*, the second accommodating portion 714*b*, and the third accommodating portion 714*c*, the water is supplied from the water supply plate 73. Therefore, the detergents accommodated in the accommodating portions are mixed with water. The water mixed with the detergents is discharged from the detergent box housing 72 through a discharge structure, and the water mixed with the detergents flows into the tub 3 through the water outlet 722, the connection pipe 722*a* and the tub water inlet 32.

Figure 4:
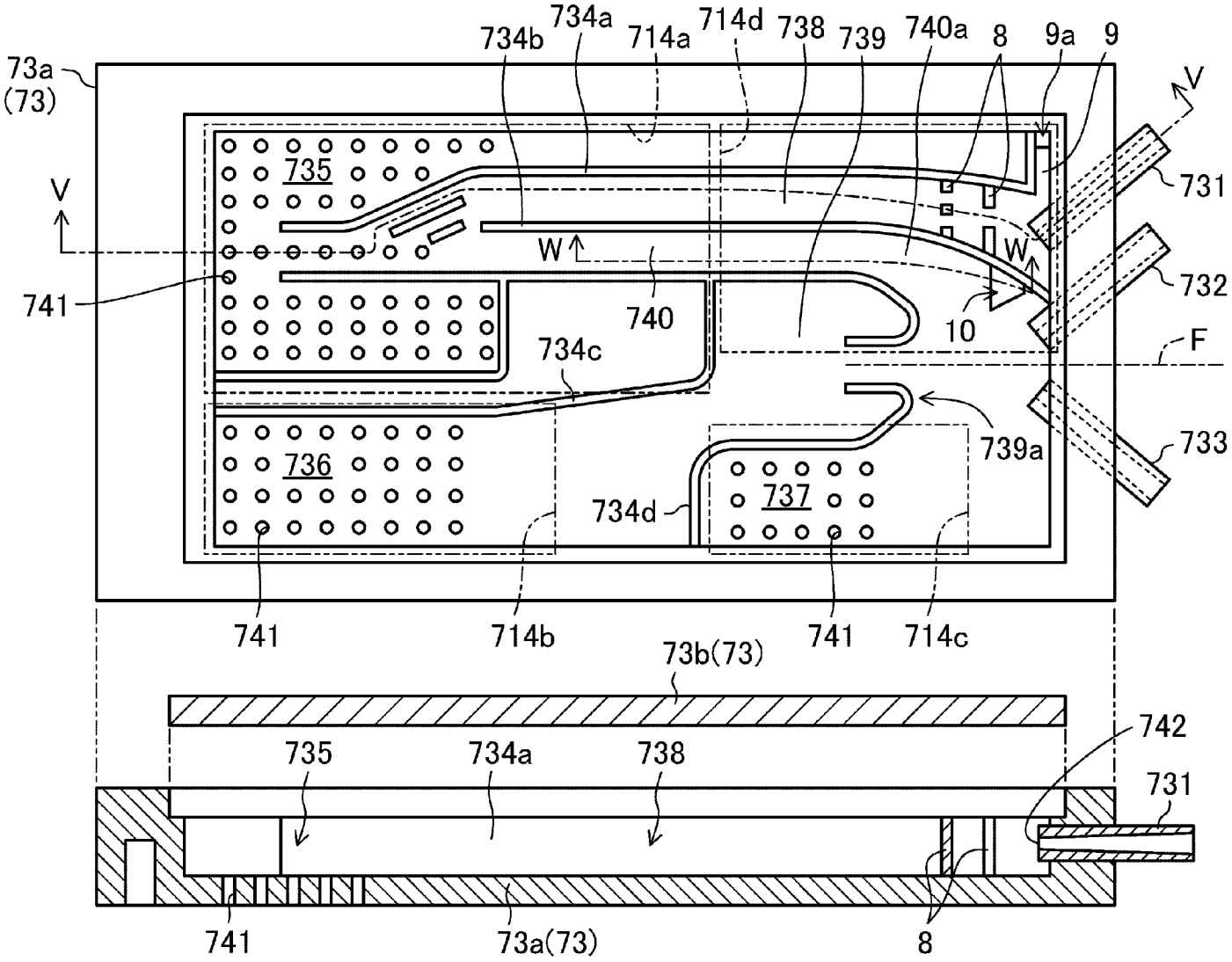
FIG. 4 is a view illustrating an internal structure of a water supply plate in the detergent supplier of the washing machine according to an embodiment of the disclosure, particularly, an upper view is a view of an inside of the water supply plate when viewed from the top and a lower view is a cross sectional view taken along line V-V of the upper view.

FIG. 2 illustrates a schematic cross-sectional view of the washing machine according to an embodiment of the disclosure, and FIG. 3 illustrates a schematic exploded perspective view of a detergent supplier of the washing machine according to an embodiment of the disclosure. FIG. 4 is a view illustrating an internal structure of a water supply plate in the detergent supplier of the washing machine according to an embodiment of the disclosure. In FIG. 4, an upper view is a view of an inside of the water supply plate when viewed from the top and a lower view is a cross sectional view taken along line V-V of the upper view.

As illustrated in FIGS. 2 to 4, the water supply plate 73 may be configured to supply water, which is supplied from the water supply pipe, to the detergent box 71. The water supply plate 73 may be formed of a rectangular plate-shaped member having a long length in the front-rear direction and having a relatively thick thickness. The water supply plate 73 may be mounted on the upper portion of the detergent housing 72 to cover the upper portion of the detergent box body 71*a* of the detergent box 71. A first water supply nozzle 731, a second water supply nozzle 732, and a third water supply nozzle 733 may be provided on a rear wall 73*bb* of the water supply plate 73.

As illustrated in FIGS. 2 and 3, the washing machine 1 may further include a water supply pipe configured to supply water to the detergent supplier 7. The water supply pipe may include a first water supply pipe 23 and a second water supply pipe 24.

The water supply plate 73 may further include the water supply nozzles 731, 732, and 733 connected to the water supply pipe. The water supply nozzles 731, 732 and 733 may include the first water supply nozzle 731, the second water supply nozzle 732, and the third water supply nozzle 733.

Through the first water supply pipe 23 provided in the body 2, the first water supply nozzle 731 may be connected to a first water supply source provided outside the washing machine 1. The second water supply nozzle 732 and the third water supply nozzle 733 may be connected to a second water source provided outside the washing machine 1 through the second water supply pipe 24 branched in the middle. That is, the second water supply pipe 24 may be branched into two water supply pipes. One of the two water supply pipes may be connected to the second water supply nozzle 732, and the other of the two water supply pipes may be connected to the third water supply nozzle 733.

One of the first water supply source and the second water supply source may supply water at room temperature (general tap water). For example, the first water supply source may supply water at room temperature, and the second water supply source may supply hot water, and vice versa.

Each branch portion of the first water supply pipe 23 and the second water supply pipe 24 may be provided with a solenoid valve 25 for opening and closing the flow path under the control of the controller. Each of the first water supply nozzle 731, the second water supply nozzle 732, and the third water supply nozzle 733 introduces water into the water supply plate 73 under control while supplying water.

The water supply plate 73 may include a plate body 73*a* having an open top surface, and a plate cover 73*b* provided to cover the open top surface of the plate body 73*a*. The plate body 73*a* and the plate cover 73*b* may form an exterior of the water supply plate 73. The plate cover 73*b* may be integrated with the plate body 73*a* by being inserted into the open top surface of the plate body 73*a*. The plate cover 73*b* may be welded to the plate body 73*a*, but the plate cover 73*b* according to an embodiment is press-fitted to the plate body 73*a*. Accordingly, the inside of the water supply plate 73 may be sealed and a wide space in the transverse direction may be formed.

As illustrated in FIG. 4, the water supply plate 73 may further include a plurality of ribs 734*a*, 734*b*, 734*c*, and 734*d*. The plurality of ribs 734*a*, 734*b*, 734*c*, and 734*d* may be provided inside the plate body 73*a*. Particularly, the plurality of ribs 734*a*, 734*b*, 734*c*, and 734*d* may be provided on the bottom surface of the plate body 73*a*. By the plurality of ribs 734*a*, 734*b*, 734*c*, and 734*d*, an inner space of the plate body 73*a* may be divided into a plurality of spaces having an open top surface. In addition, the plate cover 73*b* is press-fitted into the plate body 73*a* so that the upper portion of each space is closed, and thus a plurality of sealed spaces may be formed in the water supply plate 73. In other words, the plurality of ribs 734*a*, 734*b*, 734*c*, and 734*d* may be provided to define flow paths 738, 739, and 740.

The water supply plate 73 may further include water supply portions 735, 736, and 737 configured to supply washing water to the accommodating portions 714*a*, 714*b*, and 714*c*, and the flow paths 738, 739, and 740 configured to guide washing water, which is supplied through the water supply nozzles 731, 732, and 733, to the water supply portions 735, 736, and 737.

The water supply portions 735, 736, and 737 may include the first water supply portion 735, the second water supply portion 736, and the third water supply portion 737. The water supply portions 735, 736, and 737 may be formed in the water supply plate 73. The first water supply portion 735 may be arranged on the front left side of the water supply plate 73 and positioned above the first accommodating portion 714*a*. The second water supply portion 736 may be arranged on the front right side of the water supply plate 73 and positioned above the second accommodating portion 714*b*. The third water supply portion 737 may be arranged on the rear right side of the water supply plate 73 and positioned above the third accommodating portion 714*c*.

A plurality of washing water moving holes 741 may be formed in the water supply portions 735, 736, and 737. Particularly, the plurality of washing water moving holes 741 may be formed to pass through the bottom surface of each of the first water supply portion 735, the second water supply portion 736, and the third water supply portion 737. The first water supply portion 735 may communicate with the first accommodating portion 714*a* through the plurality of washing water moving holes 741 formed in the first water supply portion 735. The second water supply portion 736 may communicate with the second accommodating portion 714*b* through the plurality of washing water moving holes 741 formed in the second water supply portion 736. The third water supply portion 737 may communicate with the third accommodating portion 714*c* through the plurality of washing water moving holes 741 formed in the third water supply portion 737.

The flow paths 738, 739, and 740 may include the first flow path 738, the second flow path 739, and the third flow path 740. Details of the flow paths 738, 739, and 740 will be described later.

The first water supply nozzle 731, the second water supply nozzle 732, and the third water supply nozzle 733 are arranged in the transverse direction and fixed to a rear edge of the plate body 73*a*. In other words, the first water supply nozzle 731, the second water supply nozzle 732, and the third water supply nozzle 733 may be arranged on the rear wall 73*bb* of the water supply plate 73. The first water supply nozzle 731, the second water supply nozzle 732, and the third water supply nozzle 733 extend approximately parallel to a long side of the plate body 73*a* when viewed from the left and right direction corresponding to the transverse direction, as illustrated in the lower view of FIG. 4. Further, the first water supply nozzle 731, the second water supply nozzle 732, and the third water supply nozzle 733 extend in a direction inclined with respect to the long side of the plate body 73*a* when viewed from the up and down direction corresponding to the longitudinal direction, as illustrated in the upper view of FIG. 4.

Particularly, the first water supply nozzle 731 is arranged on the left side of the rear edge of the plate body 73*a* and extends from the rear left side to the front right side. The second water supply nozzle 732 is adjacent to the first water supply nozzle 731 and extends substantially parallel to the first water supply nozzle 731 from the rear left side to the front right side. In contrast, the third water supply nozzle 733 is arranged on the right side of the rear edge of the plate body 73*a* and extends from the rear right to the front left side. The third water supply nozzle 733 is arranged to be line symmetrical with the second water supply nozzle 732 with respect to an injection axis F extending in the front-rear direction. In other words, the third water supply nozzle 733 and the second water supply nozzle 732 may be arranged in a V shape with respect to the injection axis F.

The water supply nozzles 731, 732, and 733 may include a water supply hole 742 provided to supply washing water to the flow paths 738, 739, and 740. Particularly, each of the first water supply nozzle 731, the second water supply nozzle 732, and the third water supply nozzle 733 has the water supply hole 742 provided on each front end thereof. The water supply hole 742 is formed in such a way that a flow path cross section thereof becomes narrow so as to intensely spray water using the hydraulic action.

The first flow path 738 may be defined by the first rib 734*a* and the second rib 734*b*. Particularly, a side portion of the first flow path 738 is partitioned by the first rib 734*a* and the second rib 734*b* extending substantially parallel to each other, and the first flow path 783 is configured to guide the water flowing from the first water supply nozzle 731 to the first water supply portion 735. The first flow path 738 may be elongated in a band shape along the front-rear direction in the left portion of the water supply plate 73. An upstream side end of the second rib 734*b* is connected to the rear edge of the plate body 73*a*. In other words, the upstream side end of the second rib 734*b* may be connected to the rear wall 73*bb* of the water supply plate 73. A downstream side end of the second rib 734*b* is placed in the first water supply portion 735.

In contrast, an upstream side end of the first rib 734*a* is bent near the rear edge of the plate body 73*a* and then connected to the left surface portion of the plate body 73*a*. In other words, the upstream side end of the first rib 734*a* may be connected to a left wall 73*cc* of the water supply plate 73. Accordingly, a branch flow path 9 described later may be formed. A downstream side end of the first rib 734*a* is placed in the first water supply portion 735. A downstream side end of the first flow path 738 is opened to an approximate center of the first water supply portion 735. The upstream side end of the first flow path 738 is almost closed, and a front end of the first water supply nozzle 731 protrudes thereon.

The second flow path 739 may be defined by the third rib 734*c* and the fourth rib 734*d*. Particularly, a side portion of the second flow path 739 is partitioned by the third rib 734*c* and the fourth rib 734*d*, and the second flow path 739 is configured to guide the water flowing from the second water supply nozzle 732 and the third water supply nozzle 733 to the second water supply portion 736. The second flow path 739 may be elongated along the front-rear direction in the right portion of the water supply plate 73. An upstream side end of the third rib 734*c* and the fourth rib 734*d* are bent inward in a U-shape and face each other with a gap therebetween.

Accordingly, an inlet 739*a* of the second flow path 739 may be formed. The inlet 739*a* of the second flow path 739 faces a front end of the second water supply nozzle 732 and a front end of the third water supply nozzle 733 at a distance in the front-rear direction. The injection axis F passes through the approximate center of the inlet 739*a* of the second flow path 739.

A downstream side end of the third rib 734*c* is connected to a front edge of the plate body 73*a*. In other words, the downstream side end of the third rib 734*c* may be connected to a front wall 73*aa* of the water supply plate 73. A downstream side end of the fourth rib 734*d* is connected to an approximate center of the right side surface of the plate body 73*a*. In other words, the downstream side end of the fourth rib 734*d* may be connected to an approximate center of a right wall 73*dd* of the water supply plate 73. The second water supply portion 736 is partitioned by the downstream side end of the second flow path 739.

Further, the third water supply portion 737 is partitioned by the fourth rib 734*d*. An opening between the upstream side end of the fourth rib 734*d* and the right side surface of the plate body 73*a* serves as an inlet through which water flows into the third water supply portion 737.

The third flow path 740 may be defined by the second rib 734*b* and the third rib 734*c*. Particularly, the third flow path 740 may be formed between the second rib 734*b* and the third rib 734*c*. The third flow path 740 extends rearward from the first water supply portion 735 along the first flow path 738. The front end of the third flow path 740 is placed in the first water supply portion 735, and opened thereon. A rear end of the third flow path 740 is joined to an upstream portion of the inlet 739*a* of the second flow path 739 and opened thereon. In other words, the third flow path 740 may be provided between the first flow path 738 and the second flow path 739. The third flow path 740 may be provided to be joined to the second flow path 739 at an upstream side of the third flow path 740.

The second water supply nozzle 732 is directed to an entrance of the third water supply portion 737 so that the sprayed water is directed to the third water supply portion 737. The third water supply nozzle 733 is directed to an opening of the third flow path 740 so that the sprayed water is directed to the third flow path 740.

Accordingly, it is possible to supply water to the third water supply portion 737 by spraying water from the second water supply nozzle 732 without spraying water from the third water supply nozzle 733. In contrast, it is possible to supply water to the first water supply portion 735 through the third flow path 740 by spraying water from the third water supply nozzle 733 without spraying water from the second water supply nozzle 732. Further, it is possible to supply water to the second water supply portion 736 because water is sprayed from both of the second water supply nozzle 732 and the third water supply nozzle 733 and water is joined and flows along the injection axis F.

Water may be supplied to the first water supply portion 735 by spraying water from the first water supply nozzle 731. When water is sprayed from the first water supply nozzle 731 and the third water supply nozzle 733, the amount of water supplied to the first water supply portion 735 may be increased. Water supplied to the first water supply portion 735 is supplied to the first accommodating portion 714*a* through the plurality of washing water moving holes 741. Therefore, the water may be supplied to the tub 3 in the state the water is mixed with detergent.

In the same manner, water supplied to the second water supply portion 736 is supplied to the second accommodating portion 714*b* through the plurality of washing water moving holes 741. Therefore, water may be supplied to the tub in a state in which the water is mixed with the softener. The water supplied to the third water supply portion 737 is supplied to the third accommodating portion 714*c* through the plurality of washing water moving holes 741. Therefore, the water may be supplied to the tub in a state in which the water is mixed with the bleach.

When water flows into the water supply plate 73, a large amount of water may flow intensely and thus noise may occur while the water currents collide with each other.

A study for the noise is reflected in the first flow path 738 of the washing machine 1 according to an embodiment. Hereinafter the noise countermeasure will be described.

Figure 5:
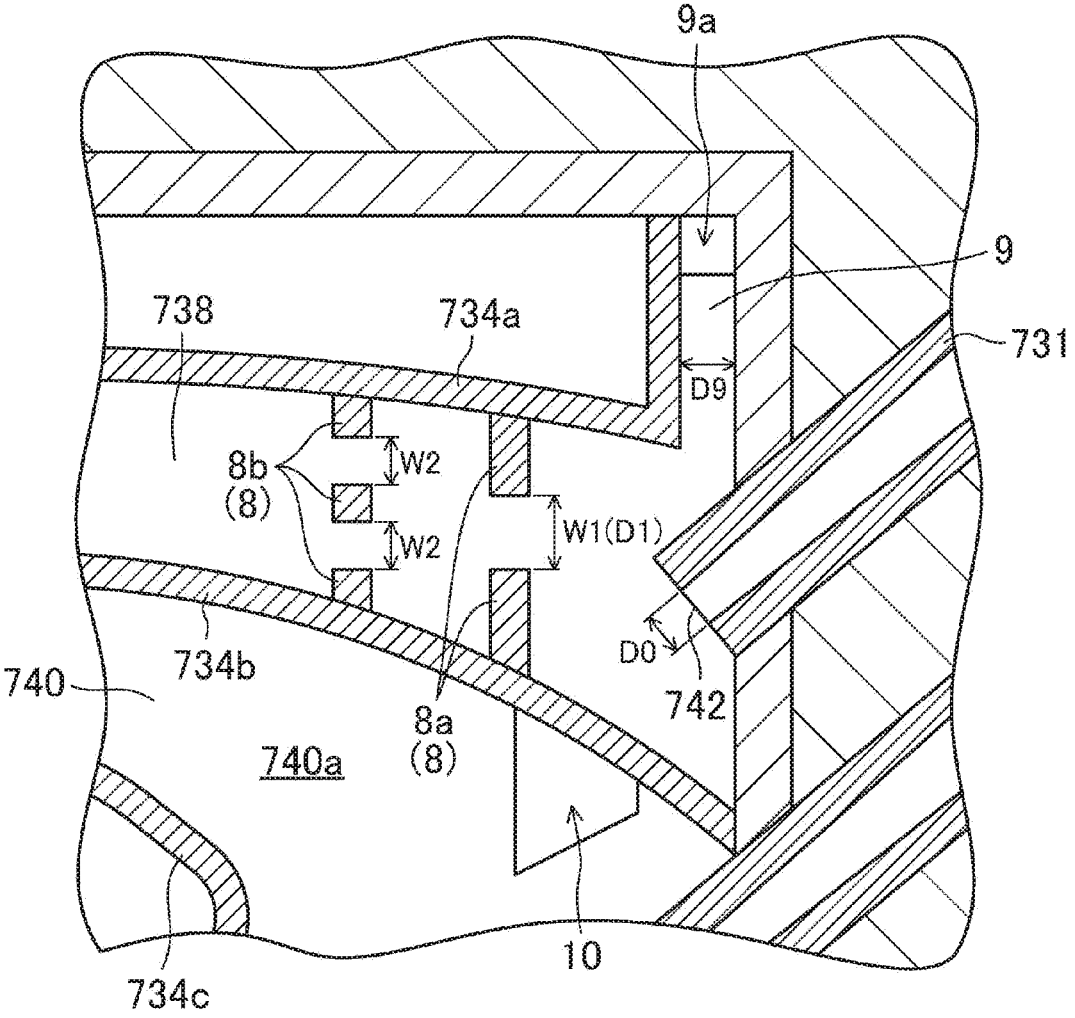
FIG. 5 illustrates an enlarged view of a main part of FIG. 4.

FIG. 5 illustrates an enlarged view of a main part of FIG. 4.

As illustrated in FIG. 5, the water supply plate 73 may further include a flow path partition 8. The flow path partition 8 is provided in the upstream side of the first flow path 738 in such a way that a flow path cross section of the first flow path 738 in the upstream side is smaller than a flow path cross section of the first flow path 738 in the downstream. The flow path partition 8 may protrude from the upstream side of the first flow path 738. The flow path partition 8 may be formed on the first flow path 738 to be spaced apart from at least one of the first rib 734*a* and the second rib 734*b*.

Particularly, a plurality of flow path partitions 8 is provided along the first flow path 738 on the upstream side of the first flow path 738. The size of the flow path cross section of the first flow path 738, which is reduced by the plurality of flow path partitions 8, becomes larger as the first flow path 738 becomes closer to the downstream of the first flow path 738.

The plurality of flow path partitions 8 may include at least one first flow path partition 8*a* spaced apart from the first water supply nozzle 731, and at least one second flow path partition 8*b* formed on the downstream side of the at least one first flow path partition 8*a* to be spaced apart from the at least one first flow path partition 8*a*. In other words, in the upstream side end of the first flow path 738, the at least one first flow path partition 8*a* and the at least one second flow path partition 8*b* are sequentially installed at a distance from the upstream side. The at least one first flow path partition 8*a* and the at least one second flow path partition 8*b* are formed by a protrusion for reducing the flow path cross section of the first flow path 738, particularly, the protrusion is formed in a small rib shape protruding from the inside of the first flow path 738. However, the shape of the flow path partition 8 is not limited thereto, and thus the flow path partition 8 may have various shapes as long as capable of reducing the flow path cross section of the first flow path 738.

Because the at least one first flow path partition 8*a* and the at least one second flow path partition 8*b* have the same top and bottom sizes, when comparing a width W1 between the at least one first flow path partitions 8*a* with a width W2 between the at least one second flow path partitions 8*b* (total value), which is proportional to the size of the flow path cross section, the width W2 between the at least one second flow path partitions 8*b* is greater than the width W1 of the at least one first flow path partition 8*a* (hereinafter the flow path cross section is expressed by D).

Accordingly, by gradually increasing the flow path cross section at a distance along the direction in which the water flows, the momentum of the flowing water may be suppressed gradually, and as a result, the noise may be effectively suppressed. In an experiment, it can be seen that a slight noise suppression effect is confirmed even when the flow path partition 8 is installed as one stage and a sufficient noise suppression effect is confirmed when the flow path partition 8 is installed as two or more stages in comparison with the singe stage of the flow path partition 8.

In addition, in the washing machine 1 according to an embodiment, the water supply hole 742 of the first water supply nozzle 731 is formed smaller than a cross section of any flow path of the first flow path 738 which is reduced by the plurality of flow path partitions 8. That is, because a flow path cross section D1 of the first flow path partition part 8*a* is larger than a flow path cross section D0 of the water supply hole 742, the same effect as when providing the flow path partition 8 having three stages may be obtained. Therefore, the noise may be further suppressed.

Because the inside of the water supply plate 73 is a narrow space, it is likely to retain water. When there is residual water, the water supply plate 73 may be damaged by freezing in a cold region. Particularly, in the washing machine 1 according to an embodiment, because the flow path partitions 8 are provided adjacent to each other in the upstream side of the first flow path 738, residual water tends to accumulate.

Therefore, the washing machine 1 according to an embodiment may effectively prevent the residual water.

The water supply plate 73 may further include the branch flow path 9. The branch flow path 9 may be provided to branch from the first flow path 738 between the at least one first flow path partition 8*a* and the first water supply nozzle 731. Particularly, the branch flow path 9 may branch from a space between the at least one first flow path partition 8*a*, which is placed at the most upstream side of the first flow path 738, and the first water supply nozzle 731, which is the space corresponds to the uppermost portion of the first flow path 738. The branch flow path 9 is provided at a corner of the rear left side of the water supply plate 73 on the side opposite to the direction to which the first water supply nozzle 731 is directed. In other words, the water supply plate 73 may include the rear wall 73*bb* (refer to FIG. 3) in which the water supply nozzles 731, 732, and 733 are arranged, the left wall 73*cc* (refer to FIG. 3) bent and extended from one end of the rear wall 73*bb*, and the right wall 73*dd* (refer to FIG. 3) bent and extended from the other end of the rear wall 73*bb* to face the left wall 73*cc*. The branch flow path 9 is provided to branch from the first flow path 738 so as to be directed to the left wall 73*cc* of the water supply plate 73, and the first water supply nozzle 731 may be installed on the rear wall 73*bb* of the water supply plate 73 in such a way that the water supply hole 742 is directed to the right wall 73*dd* of the water supply plate 73. Therefore, it is difficult for the water injected from the first water supply nozzle 731 to flow into the branch flow path 9.

Further, a flow path cross section D9 of the branch flow path 9 is formed smaller than the flow path cross section D1 of the first flow path 738 reduced by the at least first flow path partition 8*a*. Therefore, the water injected from the first water supply nozzle 731 is more difficult to flow into the branch flow path 9.

A drain hole 9*a* may be formed on the branch flow path 9. Particularly, the drain hole 9*a* may be formed at the end portion of the branch flow path 9 to penetrate the bottom surface of the water supply plate 73. In other words, the drain hole 9*a* may be formed at a corner portion of the water supply plate 73 formed by the rear wall 73*bb* and the left wall 73*cc* of the water supply plate 73. In addition, the drain hole 9*a* may be formed at the upstream side of the flow path partition 8. Particularly, the drain hole 9*a* may be formed at the upstream of the at least one first flow path partition 8*a*. Thus, the water flowing into the branch flow path 9 may fall into the preliminary fourth accommodating portion 714*d* through the drain hole 9*a*. Further, when water is not introduced from the first water supply nozzle 731, air flows into the first flow path 738 through the drain hole 9*a* and thus the inside of the first flow path 738 is maintained at atmospheric pressure. Therefore, water may sufficiently flow through the first water supply portion 735 and the first flow path 738.

In addition, the washing machine 1 according to an embodiment may prevent residual water in other space. That is, an inclined surface 740*a* is provided in an end portion of the third flow path 740 on the side of the second flow path 739 to be inclined downward toward the second flow path 739, and a drain aperture 10 is formed on a lower end of the inclined surface 740*a*. That is, the inclined surface 740*a* may be formed at the upstream side end of the third flow path 740 to be inclined downward toward the second flow path 739, and the drain aperture 10 may be formed on an end of the inclined surface 740*a* directed to the second flow path 739. The drain aperture 10 may be formed on an end of the inclined surface 740*a* to be adjacent to the second water supply nozzle 732.

Figure 6:
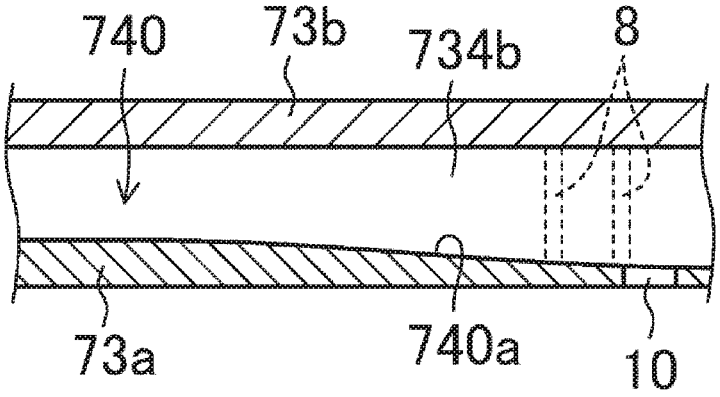
FIG. 6 illustrates a schematic cross-sectional view taken along line W-W of FIG. 4.

FIG. 6 is a schematic cross-sectional view taken along line W-W of FIG. 4.

That is, FIG. 6 illustrates a schematic cross section of an end portion of the third flow path 740 on the side of the second flow path 739. As illustrated in FIG. 6, the end portion of the third flow path 740 on the side of the second flow path 739 is formed by the inclined surface 740*a* inclined downward toward a portion joined to the second flow path 739. Further, the drain aperture 10 is formed to pass through the bottom surface along the second rib 734*b* in which the lower end of the inclined surface 740*a* is placed.

Therefore, water flowing back from the first water supply portion 735 through the third flow path 740 is guided to the drain aperture 10 by the inclined surface 740*a*, and the water falls into the preliminary fourth accommodating portion 714*d* placed below the drain aperture 10. Therefore, it is possible to prevent the water supplied to the first water supply portion 735 from being incorrectly supplied to the second water supply portion 736 or the third water supply portion 737 through the third flow path 740.

Because water collected in the second water supply portion 736 and the third water supply portion 737 is discharged through the drain aperture 10, it is possible to prevent water from being left on the second water supply portion 736 and the third water supply portion 737.

Further, as for the washing machine 1 according to an embodiment, the plate cover 73*b* is press-fitted into the plate body 73*a* without being welded on the water supply plate 73. Therefore, a gap may be generated between an upper end portion such as the second rib 734*b*, and plate cover 73*b*. Further, as for the washing machine 1 according to an embodiment, the first water supply nozzle 731 is directed to the upstream side end of the second rib 734*b*, and the front end of the first water supply nozzle 731 and the upstream side end of the second rib 734*b* are adjacent to each other. That is, the water supply hole 742 of the first water supply nozzle 731 may be directed to the second rib 734*b*.

Therefore, the water sprayed from the first water supply nozzle 731 may leak to the outside of the first flow path 738 through the gap between the second rib 734*b* and the plate cover 73*b*. On the other hand, as for the washing machine 1 according to an embodiment, the drain aperture 10 is formed on the outside of the portion to which the first water supply nozzle 731 is directed, in the first flow path 738. That is, the drain aperture 10 may be formed on the outside of the second rib 734*b* to discharge the washing water leaking from the first flow path 738. Particularly, the drain aperture 10 may be formed on the outside of the second rib 734*b* to be arranged between the first water supply nozzle 731 and the flow path partition 8. More particularly, the drain aperture 10 may be formed on the outside of the second rib 734*b* to be arranged between the first water supply nozzle 731 and the at least one first flow path partition 8*a*.

Therefore, although the water may leak from the first flow path 738, the water leaking from the first flow path 738 may be discharged through the drain aperture 10. Therefore, it is possible to prevent the water leaking from the first flow path 738 from flowing into the second water supply portion 736 or the third water supply portion 737.

In addition, as for the internal structure of the water supply plate 73, the washing machine 1 according to an embodiment may prevent the residual water and discharge the leakage by using a single drain aperture 10. Therefore, it is not required to provide a plurality of drain apertures.

Figure 7A:
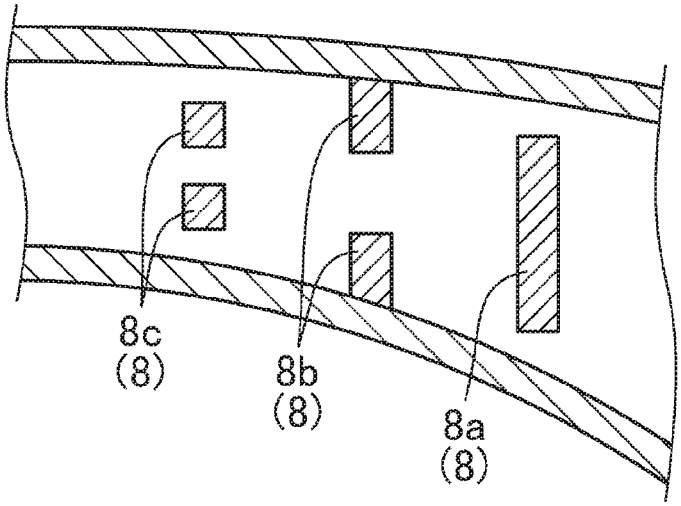
FIG. 7A is a view illustrating a modification of a flow path partition in the washing machine according to an embodiment of the disclosure.
Figure 7B:
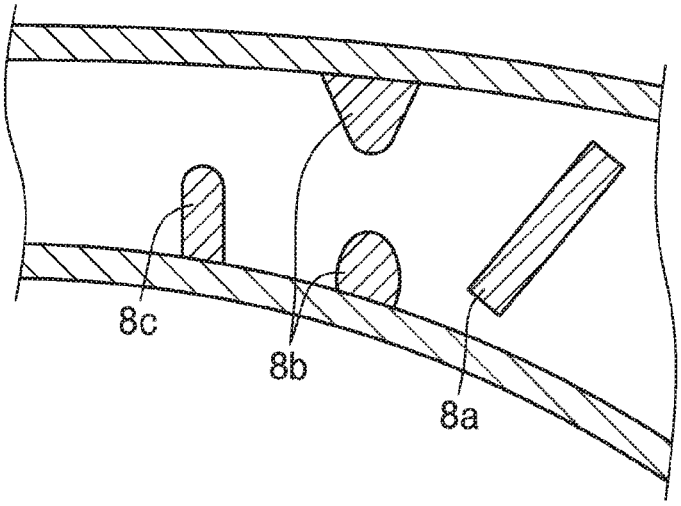
FIG. 7B is a view illustrating a modification of the flow path partition in the washing machine according to an embodiment of the disclosure.

FIG. 7A is a view illustrating a modification of a flow path partition in the washing machine according to an embodiment of the disclosure and FIG. 7B is a view illustrating a modification of the flow path partition in the washing machine according to an embodiment of the disclosure. FIGS. 7A and 7B illustrate a flow path partition having three stages 8*a*, 8*b*, and 8*c*.

It is appropriate that the flow path partition 8 is configured to reduce a cross section of a target flow path. Therefore, the shape and arrangement of the flow path partition 8 may vary according to the specification. As illustrated in a first flow path partition 8*a* of FIG. 7A, a rib configured to regulate the flow path is provided on the center of the flow path so that a flow path is generated on the left and right side of the first flow path partition 8*a*, respectively. The flow path partition 8 may be formed by multi-stages such as three stages.

Alternatively, as illustrated in a first flow path partition 8*a* of FIG. 7B, the flow path partition may be arranged to be inclined. As illustrated in a second flow path partition 8*b* of FIG. 7B, the flow path partition may have a various shape. As illustrated in a third flow path partition 8*c* of FIG. 7B, the flow path partition may be provided on only one side of the flow path. Although not shown, the flow path partition 8 may reduce the cross section in the up and down direction or in the up down left and right direction as well as reducing the cross section in the left and right direction.

It is appropriate that the flow path partitions 8 are arranged along the flow paths at a predetermined distance, and the size (area) of the flow path cross section is increased by the flow path partition 8 as the flow path becomes closer to the downstream (some of the cross section may have the same size w)

Figure 8A:
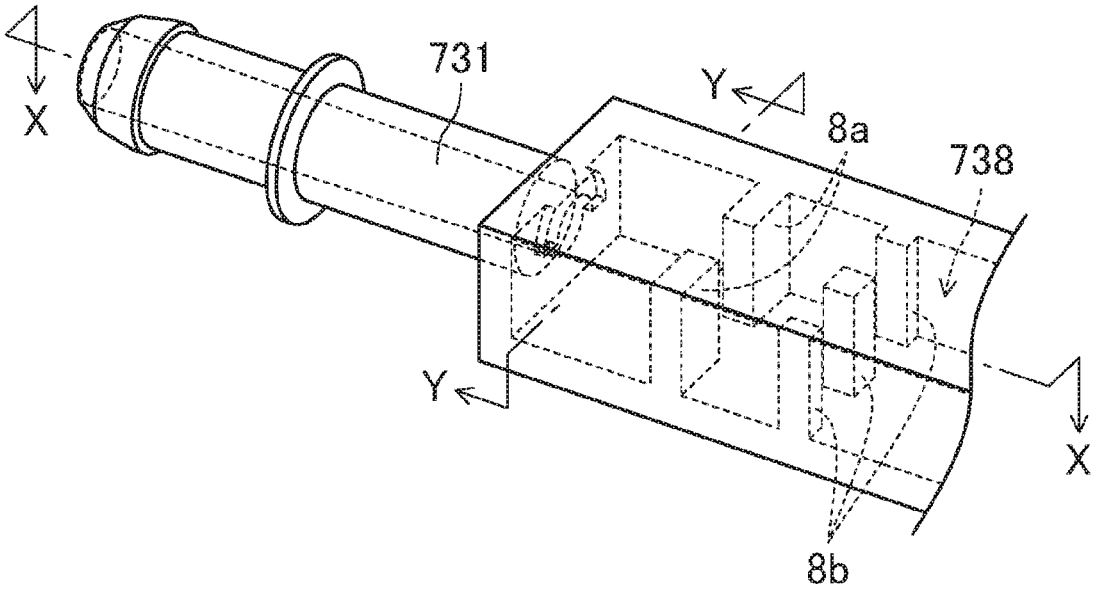
FIG. 8A is a schematic perspective view illustrating a modification of the flow path partition in the washing machine according to an embodiment of the disclosure.
Figure 8B:
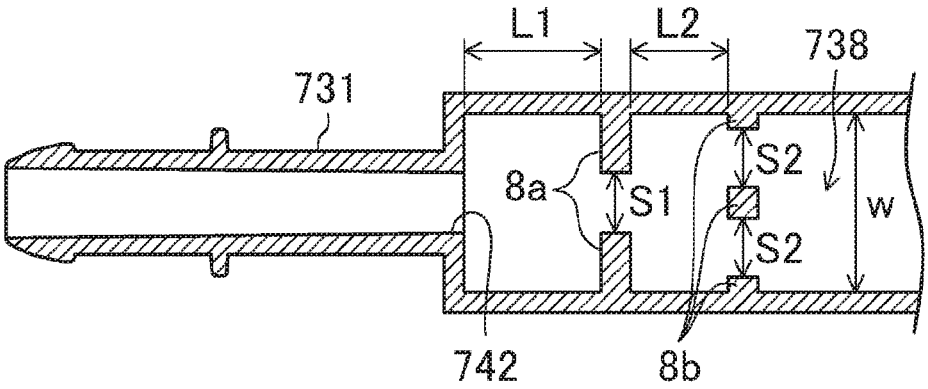
FIG. 8B illustrates a schematic cross-sectional view taken along line X-X of FIG. 8A.
Figure 8C:
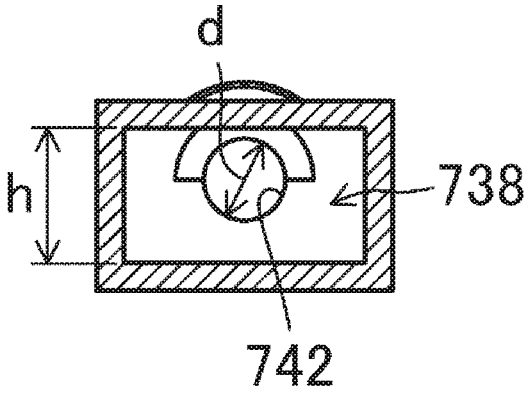
FIG. 8C illustrates a schematic cross-sectional view taken along line Y-Y of FIG. 8A.

FIG. 8A is a schematic perspective view illustrating a modification of the flow path partition in the washing machine according to an embodiment of the disclosure, and FIG. 8B illustrates a schematic cross-sectional view taken along line X-X of FIG. 8A. FIG. 8C illustrates a schematic cross-sectional view taken along line Y-Y of FIG. 8A.

According to an embodiment, a first water supply nozzle 731 and a first flow path 738 are integrally formed with each other. The first water supply nozzle 731 is connected in a straight line shape to substantially coincide with a central axis of a first flow path 738.

A diameter d of the water supply hole 742 is about 6 mm, a height h of the first flow path 738 is about 10 mm, and a width W thereof is about 18 mm. A width S1 of a vertical gap located at the center of the first flow path partition 8*a* and a width S2 of two vertical gaps of the second flow path partition 8*b* are each about 6 mm. That is, in the second flow path partition 8*b*, two gaps having the same width as the gap of the first flow path partition 8*a* may be formed in the left and right sides. The gap of the first flow path partition 8*a* may face a part positioned between the two gaps of the second flow path partition 8*b* in the flow path direction.

A length L1 from the upstream side end of the first flow path 738, in which the water supply hole 742 is formed, to the first flow path partition 8*a* is about 14 mm, and a length L2 from the first flow path partition 8*a* to the second flow path partition 8*b* is about 10 mm.

However, the technique disclosed is not limited to the above-mentioned embodiment, and other various structures are also included.

For example, in the above-described embodiment, a drum type washing machine is illustrated, but the disclosed technique may be applied to a vertical type washing machine. Although the flow path partition is provided in the first flow path according to the above-mentioned embodiment, a flow path partition may also be provided in another flow path. As an example, a flow path partition may be installed in at least one flow path. That is, the flow path partition may be provided in at least one of the first flow path, the second flow path, and the third flow path.

The number of the drain hole is not limited to a single, and its arrangement is not limited to the bottom surface. That is, the drain hole may be formed on any position if the position corresponds to a certain part in the more upstream than the flow path partition of the first flow path, such as the bottom surface or the side surface of the first flow path.

As is apparent from the above description, a washing machine may effectively supply detergent to a tub while preventing noise and residual water.

Although a few embodiments of the disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a body;

a tub arranged inside the body;

a detergent supplier configured to supply detergent to the tub; and a water supply pipe configured to supply washing water to the detergent supplier, wherein the detergent supplier comprises:

a detergent box comprising an accommodating portion in which the detergent is placed; and a water supply plate configured to supply the washing water, supplied from the water supply pipe, to the detergent box, wherein the water supply plate comprises:

a water supply nozzle connected to the water supply pipe;

a water supply portion comprising a plurality of washing water moving holes to supply washing water to the accommodating portion;

a flow path configured to guide the washing water, supplied through the water supply nozzle, to the water supply portion; and a plurality of flow path partitions formed along the flow path to be spaced apart from each other, wherein the plurality of flow path partitions comprises:

at least one first flow path partition spaced apart from the water supply nozzle, and at least one second flow path partition formed on a downstream side of the at least one first flow path partition so as to be spaced apart from the at least one first flow path partition.

2. The washing machine of claim 1, wherein the water supply nozzle comprises a water supply hole configured to supply the washing water to the flow path, wherein a flow path cross section of the water supply hole is smaller than a flow path cross section of the flow path partitioned by the at least one flow path partition.

3. The washing machine of claim 1, wherein the water supply plate further comprises a first rib and a second rib provided to define the flow path, wherein the at least one flow path partition is formed on the flow path to be spaced apart from at least one of the first rib and the second rib.

4. The washing machine of claim 1, wherein the water supply plate further comprises a branch flow path provided to branch from the flow path between the at least one first flow path partition and the water supply nozzle.

5. The washing machine of claim 4, wherein a flow path cross section of the branch flow path is smaller than the flow path cross section of the flow path partitioned by the at least one first flow path partition.

6. The washing machine of claim 4, wherein:

the detergent box further comprises a preliminary accommodating portion, and a drain hole is formed on the branch flow path to discharge the washing water to the preliminary accommodating portion.

7. The washing machine of claim 4, wherein:

the water supply nozzle comprises a water supply hole configured to supply the washing water to the flow path, the water supply plate further comprises:

a first wall on which the water supply nozzle is arranged;

a second wall being bent and extending from a first end of the first wall; and a third wall being bent and extending from a second end of the first wall to face the second wall, the branch flow path branches from the flow path to face the second wall of the water supply plate, and the water supply nozzle is arranged on the first wall of the water supply plate in such a way that the water supply hole faces the third wall of the water supply plate.

8. The washing machine of claim 7, wherein:

a drain hole configured to discharge washing water flowing into the branch flow path is formed on the branch flow path, and the drain hole is formed in a corner portion of the water supply plate formed by the first wall and the second wall.

9. The washing machine of claim 1, wherein:

the water supply plate further comprises a first rib and a second rib provided to define the flow path, the water supply nozzle comprises a water supply hole provided to face the second rib to supply washing water to the flow path, and a drain aperture configured to discharge washing water leaking from the flow path is formed on an outside of the second rib.

10. The washing machine of claim 9, wherein the drain aperture is formed on the outside of the second rib between the water supply nozzle and the at least one flow path partition.

11. A washing machine comprising:

a body;

a tub arranged inside the body;

a detergent supplier configured to supply detergent to the tub; and a water supply pipe configured to supply washing water to the detergent supplier, wherein the detergent supplier comprises:

a detergent box comprising an accommodating portion in which the detergent is placed; and a water supply plate configured to supply the washing water, supplied from the water supply pipe, to the detergent box, wherein the water supply plate comprises:

a water supply nozzle connected to the water supply pipe;

a water supply portion comprising a plurality of washing water moving holes to supply washing water to the accommodating portion;

a flow path configured to guide the washing water, supplied through the water supply nozzle, to the water supply portion; and at least one flow path partition provided to protrude on an upstream side of the flow path to allow a flow path cross section on the upstream side of the flow path to be smaller than a flow path cross section on a downstream side of the flow path, wherein the detergent box further comprises an additional accommodating portion in which detergent is placed, wherein the water supply plate further comprises:

an additional water supply nozzle connected to the water supply pipe;

an additional water supply portion comprising a plurality of washing water moving holes to supply washing water to the additional accommodating portion;

a first additional flow path configured to guide the washing water, supplied through the additional water supply nozzle, to the additional water supply portion; and a second additional flow path arranged between the flow path and the first additional flow path to guide the washing water, supplied through the additional water supply nozzle, to the water supply portion, the second additional flow path joined to the first additional flow path in an upstream side of the second additional flow path, and wherein an inclined surface inclined downward toward the first additional flow path is formed on the upstream side end of the second additional flow path.

12. The washing machine of claim 11, wherein:

the detergent box further comprises a preliminary accommodating portion, and a drain aperture is formed on an end of the inclined surface toward the first additional flow path to discharge the washing water to the preliminary accommodating portion.

13. The washing machine of claim 12, wherein the drain aperture is formed in the end of the inclined surface to be adjacent to the additional water supply nozzle.

* * * * *